US012765634B2

(12) United States Patent
Mahoney et al.

(10) Patent No.: US 12,765,634 B2
(45) Date of Patent: Oct. 20, 2026

(54) STABILITY SOLE ASSEMBLY FOR FOOTWEAR

(71) Applicant: Saucony, Inc., Waltham, MA (US)

(72) Inventors: Christopher J. Mahoney, Concord, MA (US); Gary M. Siriano, Lunenburg, MA (US); Luca B. Ciccone, Leominster, MA (US)

(73) Assignee: Saucony, Inc., Waltham, MA (US)

( * ) Notice: Subject to any disclaimer, the term of this patent is extended or adjusted under 35 U.S.C. 154(b) by 0 days.

(21) Appl. No.: 19/056,186

(22) Filed: Feb. 18, 2025

(65) Prior Publication Data

US 2026/0130460 A1 May 14, 2026

Related U.S. Application Data

(63) Continuation-in-part of application No. 29/972,934, filed on Nov. 13, 2024.

(51) Int. Cl.

| | |
|---|---|
| ***A43B 13/12*** | (2006.01) |
| ***A43B 13/14*** | (2006.01) |
| ***A43B 13/41*** | (2006.01) |

(52) U.S. Cl.

CPC ..... *A43B 13/127* (2013.01); *A43B 13/125* (2013.01); *A43B 13/141* (2013.01); *A43B 13/41* (2013.01)

(58) Field of Classification Search

CPC ... A43B 13/125; A43B 13/127; A43B 13/141; A43B 13/41; A43B 13/16; A43B 23/222; A43B 23/227

See application file for complete search history.

(56) References Cited

U.S. PATENT DOCUMENTS

| | | | | |
|---|---|---|---|---|
| 4,783,910 | A * | 11/1988 | Boys, II | A43B 7/1415 36/108 |
| 5,918,338 | A * | 7/1999 | Wong | A43B 13/37 12/146 S |
| 7,121,020 | B1 * | 10/2006 | Bathum | A43B 3/128 36/102 |

(Continued)

OTHER PUBLICATIONS

Https://www.amazon.com/Saucony-Mens-Omni-Running-Alloy/dp/B096FGMZFD/ref=asc_df_B096FGMZFD? mcid=c376a525076336fabf4f7d97fe31761c&tag=hyprod-20&linkCode=df0&hvadid=693711478225&hvpos=&hvnetw=g&hvrand=9953413291523008735&hvpone=&hvptwo=&hvqmt=&hvdev=c&hvdvcmdl=&hvlocint=&hvlocphy=9017518&hvtargid=pla-1412862585537&psc=1, dated at least as early as Feb. 17, 2025.

(Continued)

*Primary Examiner* — Megan E Lynch

(74) *Attorney, Agent, or Firm* — Warner Norcross + Judd LLP

(57) ABSTRACT

A footwear construction is provided including a sole assembly configured to slow a rate of pronation or roll during the gait cycle of a user. The sole assembly can include a midsole body, a stability platform joined with the midsole body, and a stability frame adjacent the midsole body and the stability platform on a medial side of the sole assembly. An outsole can be disposed below the midsole body and/or stability platform. The stability platform can include a lateral wing and a larger medial wing forming an unbalanced hourglass shape across the sole assembly. The stability frame and the stability platform on the medial side can be operatively configured to reduce a rate of pronation of a wearer of the footwear construction during a gait cycle of the wearer.

8 Claims, 6 Drawing Sheets

(56) References Cited

U.S. PATENT DOCUMENTS

| | | | | |
|---|---|---|---|---|
| 7,647,709 | B2 * | 1/2010 | Reilly | A43B 23/17 36/107 |
| 2003/0192202 | A1 * | 10/2003 | Schoenborn | A43B 13/16 36/31 |
| 2004/0154188 | A1 * | 8/2004 | Laska | A43B 13/186 36/31 |
| 2006/0168847 | A1 * | 8/2006 | Myers | A43B 13/16 36/103 |
| 2009/0056169 | A1 * | 3/2009 | Robinson, Jr. | A43B 13/26 36/102 |
| 2009/0249648 | A1 * | 10/2009 | Brown | A43B 13/26 36/134 |
| 2012/0233877 | A1 * | 9/2012 | Swigart | A43B 7/142 36/28 |
| 2015/0272269 | A1 * | 10/2015 | Niskanen | A43B 13/127 36/30 R |
| 2016/0353836 | A1 * | 12/2016 | Luedecke | A43B 13/16 |
| 2019/0110553 | A1 * | 4/2019 | Yoshikawa | A43B 13/18 |
| 2019/0387837 | A1 * | 12/2019 | Luh | A43B 13/026 |
| 2021/0059355 | A1 * | 3/2021 | Vizy | A43B 13/141 |
| 2021/0259356 | A1 * | 8/2021 | Maselino | A43C 1/06 |
| 2021/0345729 | A1 * | 11/2021 | Chan | A43B 13/127 |
| 2023/0000208 | A1 * | 1/2023 | Klein | A43B 7/1495 |
| 2023/0143450 | A1 * | 5/2023 | Ponomarev | A43B 7/24 36/25 R |
| 2023/0346069 | A1 * | 11/2023 | Becker | A43B 13/37 |
| 2024/0114998 | A1 * | 4/2024 | Giandolini | A43B 13/122 |
| 2024/0188680 | A1 * | 6/2024 | Ishikawa | A43B 13/026 |
| 2024/0341406 | A1 * | 10/2024 | Taoka | A43B 7/143 |

OTHER PUBLICATIONS https://www.saucony.com/en/hurricane-24/195020446850.html?gad_source=1&gclid=CjwKCAiAt4C-BhBcEiwA8Kp0CRwNsf9XLp0opzXmfFFRDRuJO1G7SRnlarCZ02pQvLgldwaZ-DYrlxoCbSMQAvD_BwE&gclsrc=aw.ds, dated at least as early as Feb. 17, 2025.

* cited by examiner

STABILITY SOLE ASSEMBLY FOR FOOTWEAR

BACKGROUND OF THE INVENTION

The present invention relates to footwear, and more particular to a sole assembly with enhanced stability for use with footwear.

There are many different types of sole assemblies used in conjunction with footwear. Many sole assemblies include a midsole constructed from foam and an underlying outsole, usually constructed from rubber for durability. The foam provides underfoot cushion, and the outsole can include lugs for traction and wear resistance. Some sole assemblies also can include a footbed above the midsole to enhance comfort while the footwear is worn by a wearer.

Recent advancements in footwear technology have focused on enhancing comfort and support, particularly through the use of extra-soft, cushioning midsoles. These midsoles, often made from materials like Expanded Thermoplastic Polyurethane (ETPU), memory foam, or gel-based compounds, are designed to provide superior shock absorption and a plush feel underfoot. As a result, shoes incorporating these materials have become popular among consumers seeking comfort, particularly for prolonged wear or during high impact activities such as running or participating in athletic events.

However, despite the comfort these shoes offer, there is a downside when it comes to the biomechanical implications of such soft cushioning. One of the major concerns is that the excessive softness and cushioning provided by these midsoles can inadvertently promote abnormal foot movements, such as excessive pronation. Pronation refers to the natural inward roll of the foot during the walking or running gait cycle. While a small degree of pronation is normal and necessary for shock absorption, excessive pronation—where the foot rolls inwards too much or at too fast of a rate during a gait cycle—can lead to a variety of musculoskeletal issues, including discomfort, pain, and injury.

The soft and highly cushioned midsoles tend to deform excessively under pressure, especially during high-impact activities, such as running or jumping. This deformation can lead to a user feeling like their underfoot structure lacks stability and promotes an unbalanced feeling, particularly on uneven surfaces. Further, due to the extra cushioning, the user may not experience adequate proprioceptive feedback from underfoot surfaces. The deformation also can increase the rate of pronation and the degree of pronation by encouraging the foot to roll inward rapidly upon or shortly after heel strike during a gait cycle, more than is biomechanically ideal. As a result, the wearer's foot alignment may be compromised, leading to additional stress on joints, tendons, and ligaments, particularly in the knees, hips, and lower back. Over time, such abnormal foot movements may contribute to conditions like plantar fasciitis, shin splints, or knee pain, which can significantly reduce the overall health and well-being of the individual.

Thus, while these soft cushioning systems provide immediate comfort, their long-term effects on foot biomechanics raise concerns about their suitability for people with specific foot types or those engaging in high-impact activities. Accordingly, there remains room for improvement in the construction of sole assemblies that address both comfort and biomechanical stability to reduce the risk of rapid or excessive pronation and its associated complications.

SUMMARY OF THE INVENTION

A footwear construction is provided including a sole assembly configured to alter a rate of pronation or roll during the gait cycle of a user.

In one embodiment, the sole assembly can include a midsole body, a stability platform joined with the midsole body, and a stability frame adjacent the midsole body and the stability platform on a medial side of the sole assembly. An outsole can be disposed below the midsole body and/or stability platform.

In one embodiment, the midsole body can define a midsole body recess that extends from a lateral side across a longitudinal axis of the midsole body to a medial side. The stability platform can include a lateral wing in the midsole body recess on the lateral side, and a larger medial wing in the midsole body recess on the medial side.

In another embodiment, the lateral wing and the medial wing can form an unbalanced hourglass shape across a width of the sole assembly, with the medial wing being larger in length on the medial side to offer more support and less compression on that side.

In another embodiment, the stability frame and the stability platform, including the larger wing on the medial side, can be operatively configured to reduce, slow or impair a rate of pronation of a wearer of the footwear construction during a gait cycle of the wearer.

In still another embodiment, the lateral wing can anchor the medial wing to the stability platform within the midsole body recess across the longitudinal axis. The stability platform can include a transition portion that can be thinner than the lateral and medial wings. The transition portion can define a trough adjacent the longitudinal axis between the lateral wing and the medial wing.

In yet another embodiment, the stability frame can include an upwardly arching shape and can be joined with the stability platform and joined with the midsole body. The stability frame can extend within the heel region and the arch region, and can be at least partially sandwiched between the stability platform and the midsole body.

In even another embodiment, the stability frame includes a first flange that transitions to a second flange that is transverse to the first flange. The first flange and the second flange can extend forwardly in a heel region and extend into an arch region. The second flange can be sandwiched between the midsole body and the stability platform. The first flange can be disposed exterior to the midsole body along the medial side and exposed to a viewer of the midsole body on the medial side.

In a further embodiment, the midsole body can be constructed from a first material, the stability platform can be constructed from a second material, and the stability frame can be constructed from a third material, with all the materials being different. The first material can be softer than the second material and the second material can be softer than the third material.

In still a further embodiment, the first material can have a durometer of 35 Asker C to 40 Asker C, inclusive, the second material can have a durometer of 50 Asker C to 60 Asker C, inclusive, and the third material can have a durometer of 50 Asker A to 55 Asker A, inclusive.

In yet a further embodiment, the first material can be Polyether Block Amide (PEBA) or polymers thereof (PEBAX), Expanded Thermoplastic Polyurethane (eTPU) or a similar material. The second material can be Ethyl Vinyl Acetate (EVA), Polyoxymethylene (POM) or a similar material. The third material can be Thermoplastic Polyurethan (TPU), polyamides like nylon, a composite, or other rigid plastic.

The current embodiments of the footwear construction and the sole assembly in particular can operatively reduce, slow or impair a rate of pronation of a wearer of the footwear construction during a gait cycle of the wearer. Thus, for those prone to pronate, their foot can be impaired or slowed in pronating during their natural gait cycle. For those not necessarily prone to pronation, the sole assembly can still provide enhanced underfoot stability. The stability platform having a different hardness can also enhance proprioceptive feedback through the sole assembly to a user's foot These and other objects, advantages, and features of the invention will be more fully understood and appreciated by reference to the description of the current embodiment and the drawings.

Before the embodiments of the invention are explained in detail, it is to be understood that the invention is not limited to the details of operation or to the details of construction and the arrangement of the components set forth in the following description or illustrated in the drawings. The invention may be implemented in various other embodiments and of being practiced or being carried out in alternative ways not expressly disclosed herein. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof. Further, enumeration may be used in the description of various embodiments. Unless otherwise expressly stated, the use of enumeration should not be construed as limiting the invention to any specific order or number of components. Nor should the use of enumeration be construed as excluding from the scope of the invention any additional steps or components that might be combined with or into the enumerated steps or components.

DETAILED DESCRIPTION OF THE CURRENT EMBODIMENTS

Figure 1:
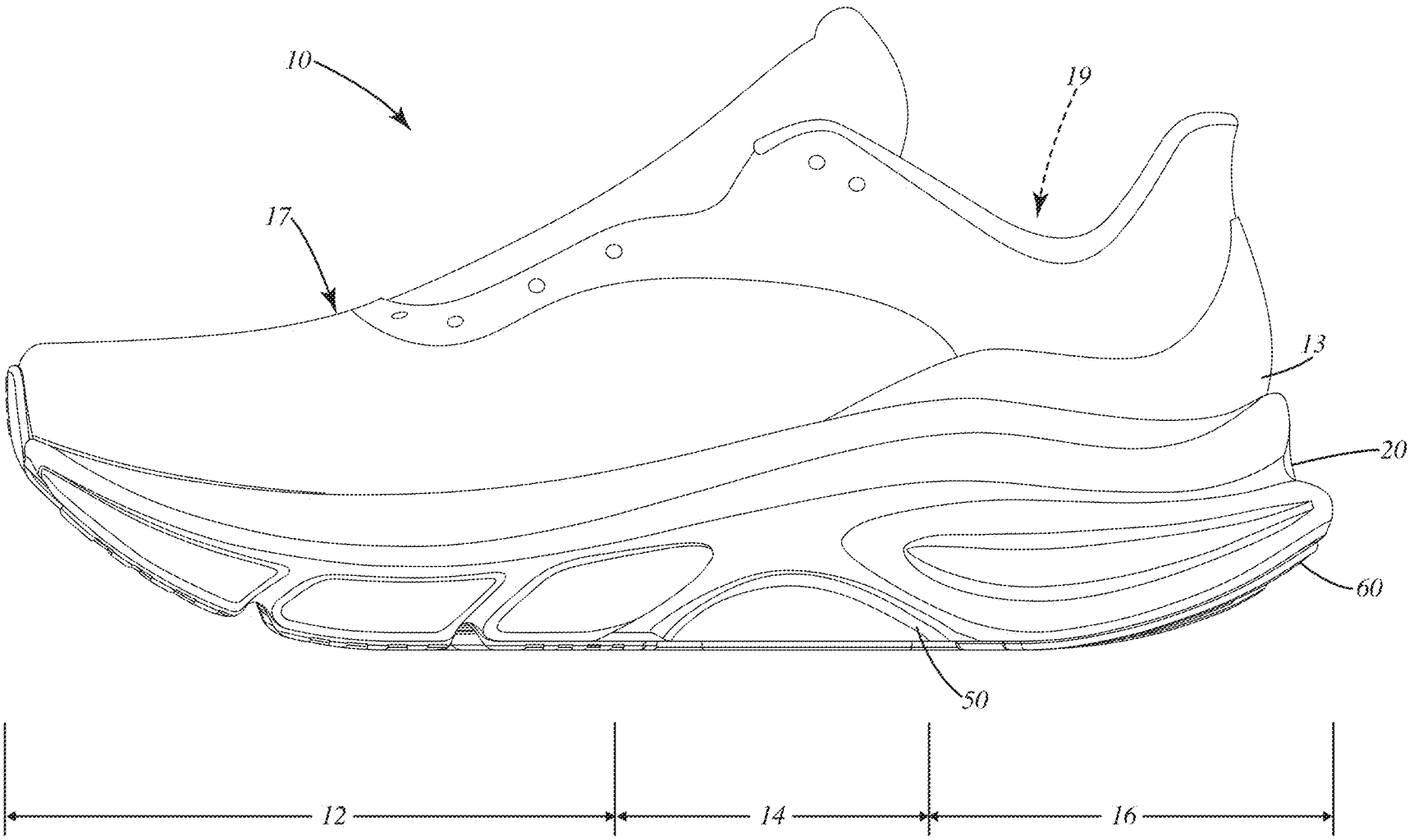
FIG. 1 is a side view of footwear of a current embodiment illustrating the sole assembly with a midsole stability platform.

A current embodiment of the footwear construction is shown in FIGS. 1-6 and generally designated 10. In this embodiment, the footwear 10 includes a sole assembly 20 including a midsole body 30 defining a midsole body recess 70, a stability platform 40 disposed in the midsole body recess 70, and a stability frame 50 adjacent the midsole body and the stability platform, with an optional outsole 60 disposed below the midsole body and/or stability platform. Although the current embodiment is illustrated in the context of a running shoe, the sole assembly thereof can be incorporated into any type or style of footwear, including performance shoes, trail shoes and boots, work boots, all-terrain shoes, hiking shoes, athletic shoes, running shoes, sneakers, conventional tennis shoes, walking shoes, multi-sport footwear, casual shoes, dress shoes or any other type of footwear or footwear components. It also should be noted that directional terms, such as "vertical," "horizontal," "top," "bottom," "upper," "lower," "inner," "inwardly," "outer" and "outwardly," are used to assist in describing the invention based on the orientation of the embodiments shown in the illustrations. Further, the terms "medial," "lateral" and "longitudinal" are used in the manner commonly used in connection with footwear. For example, when used in referring to a side of the shoe, the term "medial" refers to the inward side (that is, the side facing the other shoe) and "lateral" refers to the outward side. When used in referring to a direction, the term "longitudinal direction" refers to a direction generally extending along the length of the shoe between toe and heel, and the term "lateral direction" refers to a direction generally extending across the width of the shoe between the medial and lateral sides of the shoe.

The use of directional terms should not be interpreted to limit the invention to any specific orientation. Further, as used herein, the term "arch region" (or arch or midfoot) refers generally to the portion of the footwear or sole assembly corresponding to the arch or midfoot of the wearer's foot; the term "forefoot region" (or forefoot) refers generally to the portion of the footwear forward of the arch region corresponding to the forefoot (for example, including the ball and the toes) of a wearer's foot; and the term "heel region" (or heel) refers generally to that portion of the footwear rearward of the arch region corresponding to the heel of the wearer's foot. The forefoot region 12, arch region or mid-foot region 14, and heel region 16 generally are identified in FIG. 1; however, delineation of these regions may vary depending upon the configuration of the sole assembly and/or footwear.

With reference to FIGS. 1-4, the footwear 10 can include a sole assembly 20. The sole assembly 20 can include a midsole body 30, a stability platform 40 joined with the midsole body 30, and a stability frame 50 adjacent the midsole body and the stability platform, with an optional outsole 60 disposed below the midsole body and/or stability platform. More or fewer elements of the sole assembly 20 can be included in some embodiments. The components of the sole assembly can individually and/or collectively provide the article of footwear 10 with a number of attributes and functionality, such slowing the rate of pronation upon impact of a user with a ground surface during a normal gait cycle, reducing pronation, reducing foot roll, providing enhanced proprioceptive feedback, providing side to side support, rigidity and stability while establishing confident torsional flexibility, cushioning, comfort, reduced weight, and/or other attributes. Generally, regardless of which components are present, the sole assembly 20 can form the bottommost portion of the footwear 10. The sole assembly 20 can include a side-to-side width W, a heel-to-toe longitudinal length L and a longitudinal axis LA, which can be shared with the footwear, sole assembly, midsole body, stability platform, stability and/or the outsole.

The footwear 10 can include a textile upper 17 joined with the sole assembly 20. The upper 17 can be formed from a variety of material elements joined together to cover at least a portion of the wearer's foot. The material elements can be selected based on the intended uses of the article of footwear 10, and can include synthetic textiles, mesh textiles, polymers or leather, for example. The upper 17 can be constructed to improve the rigidity of the sole assembly 20. For example, the upper can be constructed from leather, plastic, canvas or other materials. The upper 17 can include one or more closure elements, including for example shoelaces (not shown). The upper 17 additionally includes an upper opening 19 for receiving the wearer's foot and a lower periphery or lower peripheral allowance 13 for attachment to the sole assembly 20.

Figure 6:
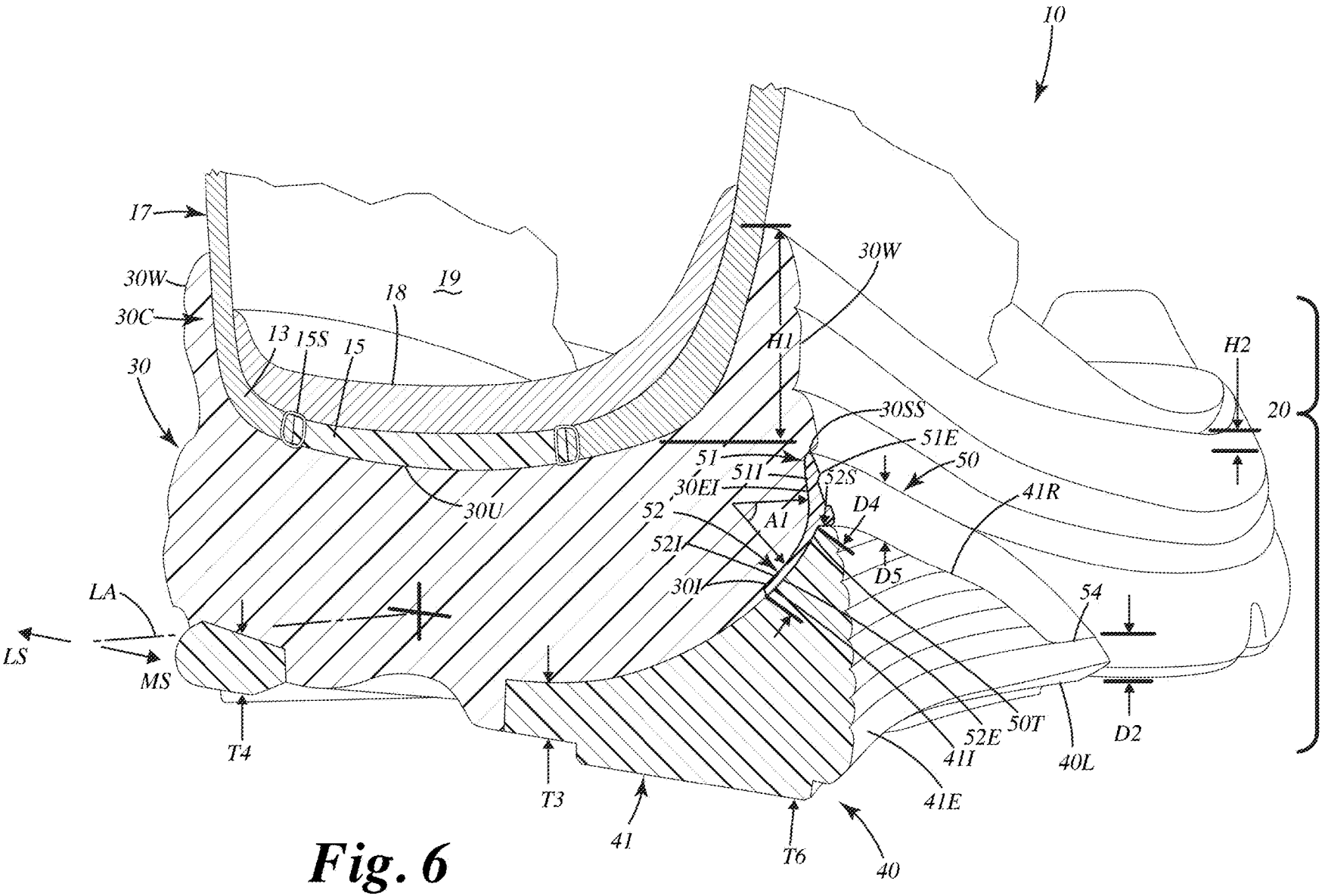
FIG. 6 is a cross section of the sole assembly of the footwear illustrating the stability frame sandwiched between the midsole and the stability platform.

A footbed 18 can be positioned within the void defined by the upper and can be non-stretchable and lightweight and joined to the upper to provide a void for receipt of the wearer's foot. The footbed can be constructed from a sheet of material, such as foam, EVA, PU, latex, gel or other materials, and by virtue of its compressibility, provide cushioning, and may also conform to the foot in order to provide comfort, support, and stability. The lower peripheral allowance 13 or edge of the upper can be stitched, cemented, or otherwise fastened to the footbed around the perimeter of the footbed. The sole assembly 20 can be combined with any other type or style of upper construction capable of being suitably joined with it, for example, a Strobel construction as shown in FIG. 6. There, the lower peripheral allowance 13 can be stitched with stitching 15S in a zigzag or other pattern to the edge of a Strobel board 15 which can extend throughout the heel region, arch region and forefoot region. The Strobel board can close the bottom of the void 19 and can be joined to the upper surface 30U of the midsole body 30. The joining of the sole assembly and optional Strobel board and the upper, or the stability platform and the midsole body, or the stability frame with the platform and body, or platform and body with the outsole components can be accomplished using adhesives, cement, injection molding, pour molding or any other technique used to join an upper and sole assembly.

With reference to FIGS. 1-6, the sole assembly 20 components will now be described in further detail. As mentioned above, the sole assembly 20 can include midsole body 30, a stability platform 40 joined with the midsole body, and a stability frame 50 adjacent the midsole body and the stability platform, with an optional outsole 60 disposed below the midsole body and/or stability platform.

The midsole body 30 can include a midsole body upper surface 30U that can be in the shape of the upper 17 and can be configured to outline a wearer's foot. The upper surface 30U can be bounded at least partially by first upstanding midsole wall 30W. This first upstanding midsole wall 30W can extend from the toe to the heel, becoming generally greater in height as it extends toward the heel region. For example, the wall can go from a height H2 in the forefoot to a height H1 in the heel. The height H1 can be greater than the height H2. With the greater height H1 in the heel region, the wall 30W can form a heel cup to add stability to the upper 17 and a wearer's heel when positioned in the upper. The first upstanding midsole wall 30W can extend upwardly adjacent a lower peripheral allowance 13A of the upper 17, at least partially concealing that lower peripheral allowance 13 also referred to herein as an upper lower allowance or a lower portion of the upper. The upstanding midsole wall 30W can approximate a shape of a wearer's foot.

The midsole body 30 can include a midsole body lower surface 30L disposed opposite the upper surface 30U. The lower surface 30L can extend across a majority of the width W of the sole assembly, and along a length L, with the exception of a midsole body recess 70 defined in the lower surface 30L. The recess 70 can interrupt the lower surface, optionally in the rear of the forefoot region 12, through part or all of the arch region 14 and into at least a portion of the heel region 16. The midsole body 30 can extend longitudinally from and/or within the heel region 16, through or into the arch region 14, and to or into the forefoot region 12. The midsole body 30 can include the longitudinal axis LA disposed between a lateral side LS and the medial side MS of the footwear and sole assembly.

Figure 5:
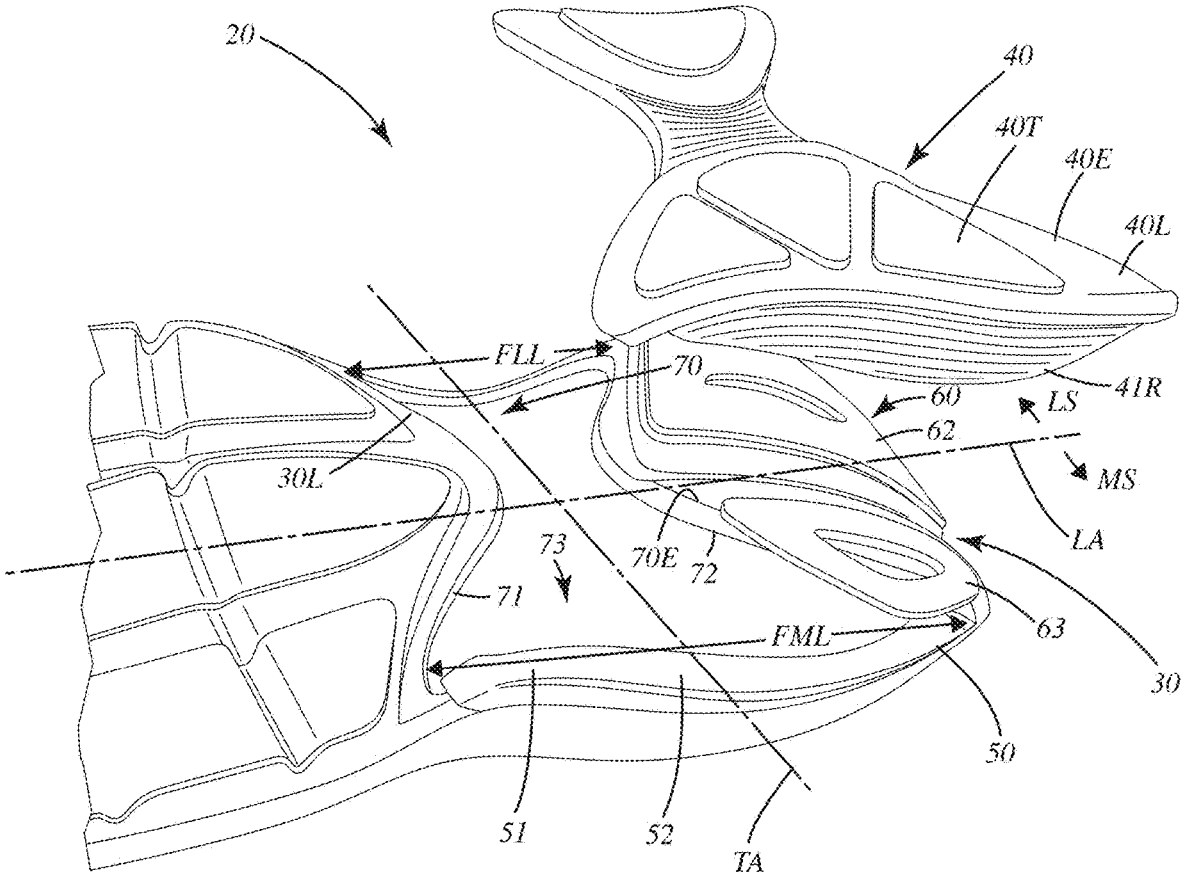
FIG. 5 is a bottom perspective view of the sole assembly with the stability platform exploded from a midsole stability recess defined by the midsole.

As shown in FIGS. 5-6 the midsole body can define the midsole body recess 70 extending from the lateral side LS to the medial side MS. The midsole body recess 70 can have a first lateral length FLL extending on the lateral side LS and can have a first medial length FML extending on the medial side MS. The stability platform lateral wing 42 and medial wing 41 can have similar or identical lengths. As shown in FIG. 5, the first medial length FML can be greater than the first lateral length FLL. Optionally, the first medial length can be 1.25, 1.5, 2.0, 2.25, 2.5 times the first lateral length. The lengths can be measured along lines parallel to the longitudinal axis, at an outermost part of the recess 70, or at the longest dimension of the recess on the lateral and medial sides.

As shown in FIG. 5, the midsole recess 70 can include a forward wall or first wall 71 and a rear wall or second wall 72. The first wall can be farther forward than the rear wall. The first wall can be in the arch and/or forefoot region. The rear wall 72 can be in the heel and/or arch region. The first lateral length FLL and the first medial length FML can extend between those respective walls on opposing sides of the longitudinal axis LA. The forward wall 71 and rear wall 72 can be somewhat mirrored relative to one another about a transverse axis TA that extends through and bisects the midsole body recess 70. The forward wall 71 and rearward wall 72 can extend from a bottom 73 of the recess upward to a midsole body lower surface 30L of the midsole body 30. When looked at in the bottom view shown, for example, in FIG. 2, the forward wall and rearward wall can generally form an unbalanced or offset hourglass shape HG, with the part of the hourglass on the medial side MS being larger than the part of the hourglass on the lateral side LS, flaring out more from the transverse axis TA on the medial side. The same can be true for the stability platform 40 described in more detail below, which also can form this type of unbalanced hourglass shape. The unbalanced hourglass shape HG optionally can ensure that the medial wing 41 of the stability platform 40 is larger than, and can provide more support on, the medial side MS than the lateral wing 42 provides support on the lateral side LS during the gait of a user.

Figure 3:
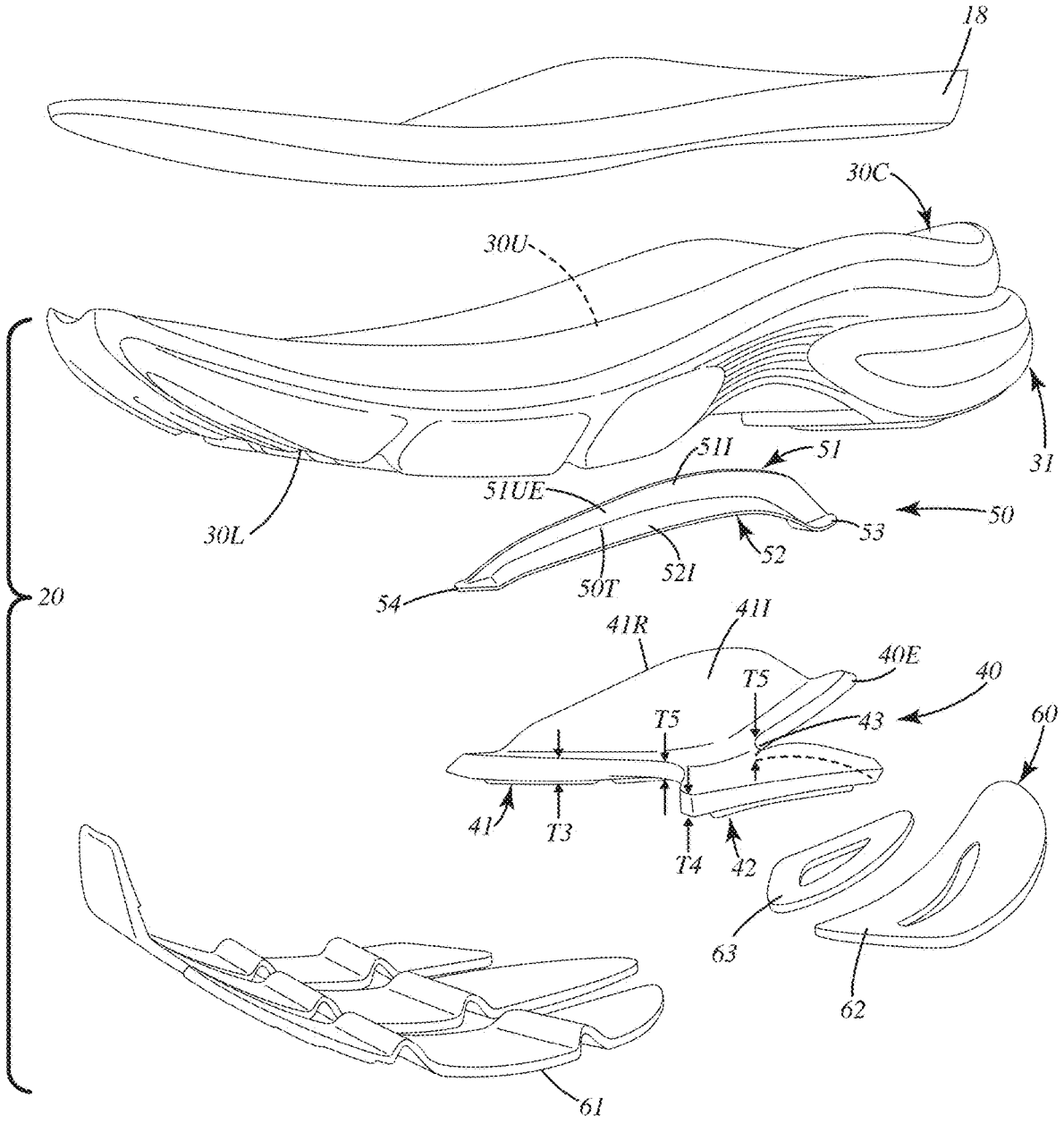
FIG. 3 is a lateral side exploded view of the sole assembly showing the midsole stability platform, a stability frame and an outsole.
Figure 4:
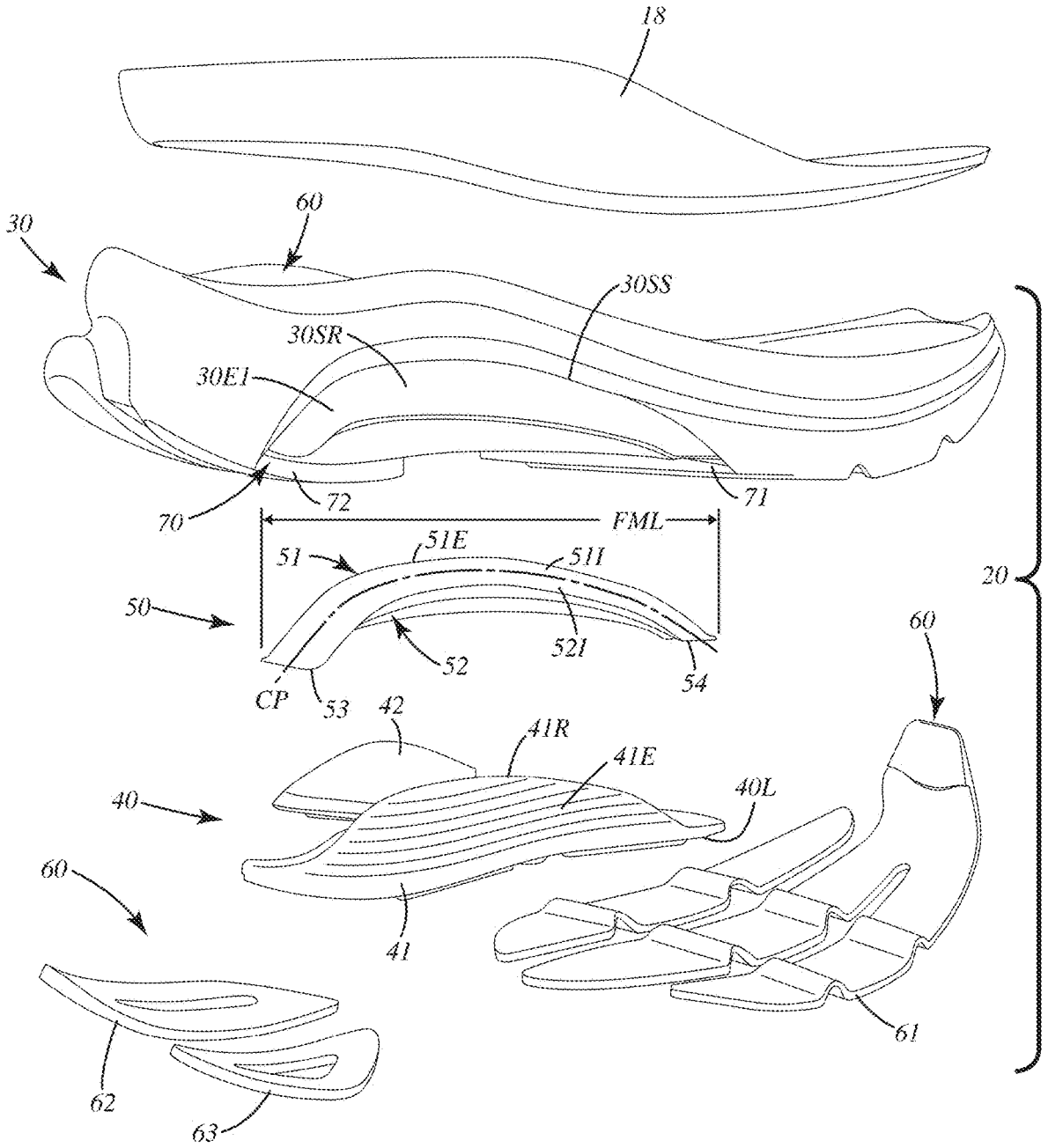
FIG. 4 is a medial side exploded view of the sole assembly showing the midsole stability platform, the stability frame and the outsole.

With reference to FIGS. 3, 4 and 6, optionally the midsole body can include a heel cup 30C formed via the wall 30W extending upwardly from the upper surface 30U of the midsole body upon which or adjacent which a user's foot is disposed. The heel cup and in particular the wall 30W can extend upward along the peripheral allowance 13 of the upper, also referred to herein as the upper lower allowance. The amount of extension along the allowance in the heel cup 30C can be the height H1 of the wall. Of course, in other applications, the heel cup 30C can be less pronounced, and the height of the wall H1 can be decreased in the heel region.

Turning to FIGS. 3-5, the midsole body can include the stability platform 40. As mentioned above, the stability platform can be disposed at least partially in and can extend within the midsole body recess 70 from the heel region 16 into and/or through the arch region 14 and in some cases at least partially into the forefoot region 12. As mentioned above, the stability platform 40 can include a medial wing 41 and a lateral wing 42. The medial wing can extend on the medial side MS of the longitudinal axis LA and the lateral wing 42 can extend on the lateral side LS of the longitudinal axis LA. These wings can be joined by a transition portion 43 that extends across the longitudinal axis LA and can be generally parallel to that longitudinal axis LA. The lateral wing 41 can be disposed in the midsole body recess and extending along the first lateral length FLL on the lateral side LS. The medial wing 41 can extend along the first medial length FML on the medial side MS.

Figure 2:
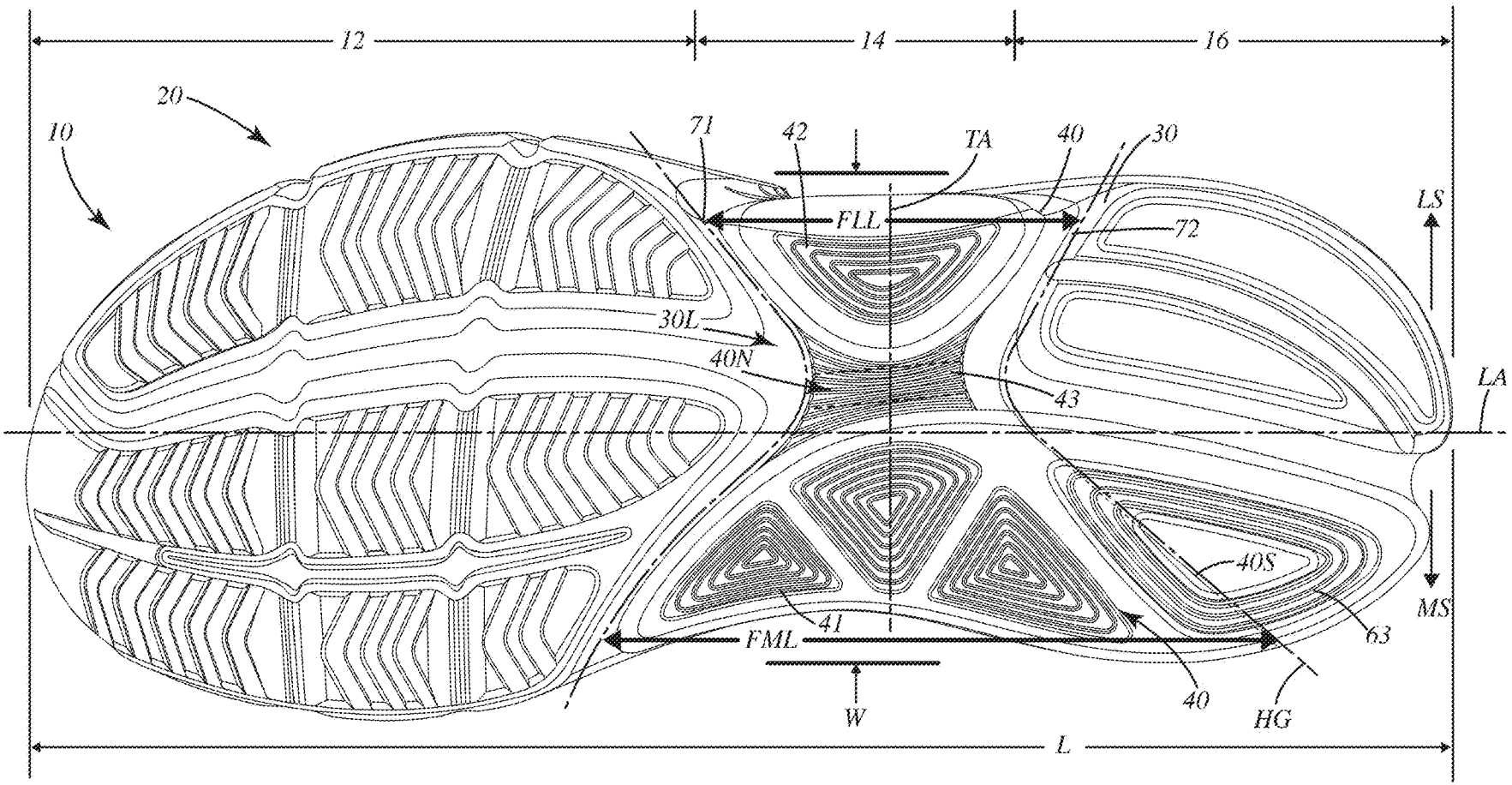
FIG. 2 is a bottom view of the sole assembly illustrating the midsole stability platform extending primarily on a medial side of the footwear.

Optionally, the medial wing 41 and lateral wing 42 can form or be in the general unbalanced hourglass shape HG as shown in FIG. 2 when viewed by user from a bottom view of the footwear 10. As illustrated there, the medial wing 41 can be larger than the lateral wing. Generally, the medial wing 41 can have a greater lower surface area and optionally a greater volume than the lateral wing 42. The first length of the medial wing, for example FML, can be greater than the length of the lateral wing, for example FLL, such that the medial wing extends farther within the heel region and arch region on the medial side than the lateral wing extends within the heel region and the arch region on the lateral side. The lateral wing 42 can be disposed on the opposite side of the longitudinal axis LA from the medial wing 41 and the neck 40N can span across the transition portion 43.

Optionally, the lateral wing 42 can anchor the medial wing 41 to the midsole platform a greater degree within the midsole body recess across the longitudinal axis LA. The stability platform thus does not only include a medial wing 41 on one side of the longitudinal axis LA, and instead the platform anchors to the midsole body 30 via both the medial wing 41 and the latter wing 42 on both the medial side MS and lateral side LS. While the lateral wing 42 may not provide substantial stability and support in the arch region or generally provides less stability and support in the arch region than the medial wing 41, that lateral wing can still optionally provide a function of anchoring the midsole platform 40 on both sides of the longitudinal axis LA to the midsole body 30.

As mentioned above, the medial wing 41 can extend along the first medial length FML and the lateral wing 42 can extend along the first lateral length FLL. Within these lengths, the wings can have different thicknesses that optionally can correspond to the thickness or depth of the midsole body recess 70. For example, as shown in FIG. 3, the medial wing 41 can include a thickness T3 and the lateral wing can include a thickness T4. These thicknesses T3 and T4 can be optionally the same and/or equal along the bottom portion of the sole assembly, as they near the transition portion 43. The transition portion however can be thinner and can have a lesser thickness T5. This thickness T5 can be less than the thicknesses T3 and T4 of the medial wing 41 and lateral wing 42. This transition portion 43 also can define a trough or thinned portion 43T shown in FIG. 2 of the midsole platform. This transition portion, optionally including the trough 43T, can provide greater torsional flexibility about the longitudinal axis LA of the sole assembly 20. This transition portion 43T however can still anchor and connect the lateral wing 42 to the medial wing 41. With this connection, the stability platform can provide a level of proprioceptive feedback through the stability platform from both lateral and medial sides due to under foot terrain and/or ground surfaces during a gait cycle of a user.

As shown in FIG. 6, the medial wing 41 of the stability platform 40 also can become thicker as it extends on the medial side MS away from the longitudinal axis LA. For example, near the longitudinal axis LA, the wing 41 can have a thickness T3. As the medial wing 41 transitions away from the longitudinal axis LA, however, the medial wing can becomes thicker until it is of a thickness T6 adjacent the exterior surface 41E of the medial wing that can be viewed by a user. This greater thickness T6 can provide enhanced stability on the medial side MS of the footwear to the user.

As mentioned above, the sole assembly 30 can include an outsole 60. This outsole 60 can comprise various tread portions, for example, a forefoot tread portion 61 and rear tread portions 62 and 63. These tread portions can come in a variety of different shapes and sizes depending on the application and ground surface or terrain upon which the footwear will be used. The outsole and various tread portions can be constructed from one or more materials, for example, natural or synthetic rubber, thermoplastic polyurethane elastomers (TPU), nylon, polymer blends, wear resistant polymers, elastomers and/or other materials. Other materials, such as fiber-reinforced polymers can be used, which can include epoxy, polyethylene or thermosetting plastic reinforced with carbon, glass and/or aramid fibers for enhanced protection.

As shown in FIGS. 2 and 5, the outsole 60 and the tread portions can extend below and under the stability platform lower surface 40L and the midsole body lower surface 30L. Certain parts of the midsole platform can form ground contacting treads 40T which can extend downward from the stability platform lower surface 40L. The stability platform lower surface 40L can include a stability platform lower surface edge 40E that can extend around the perimeter of the stability platform 40 and optionally can take on the unbalanced hourglass shape described above. The midsole body lower surface 30L also can include a midsole body lower surface edge 70E. This edge can correspond to the rear wall 72 and/or the front wall 71 of the recess 70 or other portions of the midsole body that are adjacent the midsole platform 40. As shown, the stability platform lower surface edge 40E can be disposed adjacent the midsole body lower surface edge 70E along a seam 40S. As shown in FIG. 2, the medial outsole tread 63 can be disposed adjacent and can overlap and span across the seam 40S formed between the stability platform lower surface 40L and the midsole body lower surface 30L. The outsole treads, such as the medial outsole tread 63, can cover a portion of the midsole body lower surface 30L as well as a portion of the stability platform lower surface 40L. Optionally, the stability platform lower surface and the midsole body lower surface can be substantially flush or even with one another along the seam or where they are adjacent one another. Where the outsole tread is glued, adhered, molded or otherwise disposed across and joining the respective midsole body lower surface and stability platform lower surface, that outsole tread can better secure those components to one another across the seam and can in some cases prevent delamination or separation of the stability platform from the midsole wall and the recess wall.

The sole assembly 20 and its components can be constructed from a variety of different materials to provide the stability mentioned above, the proprioceptive feedback from under foot terrain or ground surfaces, as well as to prevent, slow and/or impair the rate of pronation during a natural gait of a user of the footwear. As an example, the midsole body 30 can be constructed from a first material, the stability platform 40 can be constructed from a second material, and the stability frame 50 can be constructed from a third material, with all the materials being different. Optionally, the first material can be softer than the second material and the second material can be softer than the third material. For example, the first material can have a durometer of 35 Asker C to 40 Asker C, inclusive, 36 Asker C to 39 Asker C, inclusive, about 38 Asker C, or other durometers. The second material can have a durometer of 50 Asker C to 60 Asker C, inclusive, of 52 Asker C to 58 Asker C, inclusive, about 55 Asker C or other durometers. The third material can have a durometer of 50 Asker A to 60 Asker A, inclusive, 50 Asker A to 55 Asker A, inclusive, about 53 Asker A, or other durometers, depending on the application.

Further optionally, the first material can be Polyether Block Amide (PEBA) or polymers thereof (PEBAX), Expanded Thermoplastic Polyurethane (eTPU) or a similar material. The second material can be Ethyl Vinyl Acetate (EVA), Polyoxymethylene (POM) or a similar material. The third material can be Thermoplastic Polyurethan (TPU), polyamides like nylon, a composite, or other rigid plastic to provide some rigidity, stability and structural support to the sole assembly.

With reference to FIGS. 4-6, the stability frame 50 of the sole assembly 20 will now be described in further detail. As mentioned above, the stability frame 50 can include an upwardly arching shape. That upwardly arching shape can form a generally elongated arc on the medial side of the footwear, following a curved path CP shown in FIG. 4. This curved path can have multiple compound curvatures to it in transitioning from the heel region toward the arch region and/or forefoot region. The stability frame can include a rearward edge or end 53 and a forward edge or end 54 at which the stability frame terminates. The stability frame 50 can include a first flange 51 and a second flange 52.

The first flange 51 can transition to the second flange 52 and the first and second flanges can be generally transverse to one another or generally curve or angle in different directions. For example, the first flange 51 can extend upwardly toward the upper lower allowance 13 and/or generally the upper 17 as shown in FIG. 6. The second flange 52 can extend inwardly, toward the longitudinal axis LA. The first and second flanges can be offset at a first angle relative to one another. This angle optionally can be an obtuse angle, but in other cases it can be a right angle or acute angle. In some cases, the angle can be optionally 90° to 170°, inclusive, 90° to 160°, inclusive, 100° to 120°, inclusive, 100° to 150°, inclusive, 120° to 150°, inclusive, 120° to 160°, inclusive, or other angles depending on the application. Moreover, as shown in FIG. 6, the flanges 51 and 52 can transition to one another at a transition portion 50T. At this transition portion, the stability frame can be radiused as shown and/or can form a corner that has a radiused portion where the two flanges meet and transition to one another.

The first flange 51 and the second flange 52 of the stability frame 50 can extend forwardly in and through the heel region and can extend into and/or at least partially through the arch region and in some cases into the forefoot region, generally following an arched or rounded shape. This rounded shape can be convex, generally extending and rounding upwardly, away from a lowermost surface of the stability platform or an underfoot ground surface. The stability frame can be disposed and extend substantially only on the medial side MS of the longitudinal axis LA. There might not be any other stability frame or comparable structure on the lateral side LS. The stability frame 50 also can extend substantially along the first medial length FML of the recess and/or of the medial wing 41. As shown in FIG. 6, however, the forward end 54 of the stability frame can terminate the distance D2 above the lower surface 40L of the stability platform. Optionally, in other applications, that forward end 54 can extend down to, and form a portion of, the lower surface 40L, wrapping under the exterior side wall 41E of the stability frame and transitioning to the lower surface 40L of the stability frame. The stability frame 50 optionally can be of a length greater than the first lateral length FFL on the opposite side of the longitudinal axis LA.

The stability frame 50 can be coextensive with the upper medial rim 41R of the medial wing 41 extending along the medial side MS of the stability platform 40. The stability frame can be joined with the medial wing, along the upper medial rim 41R of the stability platform 40. The stability frame also can be joined with the midsole body 30. In particular, first flange 51 can include an interior 51I and an exterior 51E. The second flange 52 can include an interior 52I and an exterior 52E. The interior 51I of the first flange 51 can be joined with an exterior surface 30E1 of the midsole body 30. That exterior surface 30E1 might not be truly exterior because the flange 51 can cover that exterior surface 30E1 when it is attached thereto via bonding or any other joining technique. The first flange thus can extend outwardly from the exterior surface 30E1 concealing that exterior surface 30E1. In some cases, the exterior surface can include or be formed as a recess 30SR which can receive the first flange 51 therein as shown in FIG. 4.

The midsole body 30 can include a midsole body shoulder 30SS that can extend outwardly farther than the exterior surface 30E1. The first flange 51 can include a first flange upper edge 51E that can be abutted against and/or placed generally adjacent the shoulder 30SS. That shoulder 30SS can jut outward and project farther away from the exterior then the flange upper edge 51E in some cases. Accordingly, with this overlap, the midsole body can spill over that top edge 51E during a natural gait cycle to provide additional impact absorption yet provide the stability and structural support through the frame 50 to the midsole body and thus the user's foot.

As shown in FIGS. 4, 5 and 6, the first flange 51 can extend outwardly from the exterior surface 30E1 of the midsole body. The first flange thus can be visible to a user over the medial wing 41 from a side view of the footwear 10. The first flange 51 can be visible above the upper medial rim 41R. The interior surface 51I of the first flange 51 can face inwardly. The second flange 52 can be sandwiched between the stability frame 40 and the midsole body 30. In particular, the second flange 52 can be sandwiched and disposed between the midsole body 30 and the frame 40. More particularly, the interior 52I of the second flange 52 can be bonded, joined with, or adjacent the interior surface 30I of the midsole body 30 which can be contiguous with the noted exterior 30E1. The exterior surface 52E of the second flange 52 can face outwardly and can be engaged by the interior surface 41I of the medial wing 41 adjacent the upper medial rim 41R. This flange 52 can be sandwiched between the midsole and the stability frame throughout a substantial portion of the length of the stability frame, generally between the first and second ends of the stability frame. The flange 52 can be sandwiched between the midsole body and the medial wing 41 for a distance D4 that extends from the exterior of the midsole body toward the longitudinal axis LA of the stability frame. The distance D4 can be at least 5 mm, at least 10 mm, at least 15 mm, at least 20 mm or other distances. The distance D4 can be equal to or greater than the distance D5 above which the stability frame and first flange 51 extend above the upper medial rim 41R.

Optionally, the exterior 51E of the first flange and the exterior 52E of the second flange 52 can meet at a shoulder 52S. In some cases, the shoulder can project outwardly from either of the exterior surfaces of the flange. The upper rim 41R can nest within or be disposed adjacent or about this shoulder 52S in some cases. The first flange 51 can become thicker as it transitions from the upper edge 51E to the transition 50T such that the upper flange 51 forms the shoulder 52S. The second flange 52 can be thinner than the first flange adjacent to the shoulder 52S to further accentuate the shoulder. The rim 41R can be of a thickness that is the same depth as the shoulder 52S so as to provide a clean transition between the exterior 41E of the medial wing in the exterior surface 51E of the first flange 51 when visible to a viewer. In other cases, the shoulder can be absent in the first and second flanges, can be of a substantially similar or identical thickness, such that there is no shoulder projecting therefrom.

Although shown as a generally U or C shaped element, the stability frame 50 alternatively can be of a more pronounced L or V shape depending on the amount of support and rigidity to be offered adjacent the medial wing 41 and on the medial side MS of the footwear, to slow, impair and/or prevent pronation during the natural gait cycle of the user wearing the footwear 10. The support frame, with its harder material being disposed on the medial side can contribute to this effect. Further, the greater amount and volume of the medial wing 41 on the medial side MS can contribute to this effect of slowing preventing and/or impairing pronation during the gait cycle. It will be appreciated that the extent of the medial wing 41 and the stability frame 50 along the medial side can be altered to overlap the heel region, arch region and forefoot region in different degrees to accommodate a variety of different users having different pronation tendencies. As shown, the stability platform 40 and stability frame 50 in the dimensions shown can fit a wide variety of users, including typical over pronators, neutral users and others.

Although the different elements and assemblies of the embodiments are described herein as having certain functional characteristics, each element and/or its relation to other elements can be depicted or oriented in a variety of different aesthetic configurations, which support the ornamental and aesthetic aspects of the same. Simply because an apparatus, element or assembly of one or more of elements is described herein as having a function does not mean its orientation, layout or configuration is not purely aesthetic and ornamental in nature.

Directional terms, such as "vertical," "horizontal," "top," "bottom," "upper," "lower," "inner," "inwardly," "outer" and "outwardly," are used to assist in describing the invention based on the orientation of the embodiments shown in the illustrations. The use of directional terms should not be interpreted to limit the invention to any specific orientation(s).

In addition, when a component, part or layer is referred to as being "joined with," "on," "engaged with," "adhered to," "secured to," or "coupled to" another component, part or layer, it may be directly joined with, on, engaged with, adhered to, secured to, or coupled to the other component, part or layer, or any number of intervening components, parts or layers may be present. In contrast, when an element is referred to as being "directly joined with," "directly on," "directly engaged with," "directly adhered to," "directly secured to," or "directly coupled to" another element or layer, there may be no intervening elements or layers present. Other words used to describe the relationship between components, layers and parts should be interpreted in a like manner, such as "adjacent" versus "directly adjacent" and similar words. As used herein, the term "and/or" includes any and all combinations of one or more of the associated listed items.

The above description is that of current embodiments of the invention. Various alterations and changes can be made without departing from the broader aspects of the invention as defined in the appended claims, which are to be interpreted in accordance with the principles of patent law including the doctrine of equivalents. This disclosure is presented for illustrative purposes and should not be interpreted as an exhaustive description of all embodiments of the invention or to limit the scope of the claims to the specific elements illustrated or described in connection with these embodiments. For example, and without limitation, any individual element(s) of the described invention may be replaced by alternative elements that provide substantially similar functionality or otherwise provide adequate operation. This includes, for example, presently known alternative elements, such as those that might be currently known to one skilled in the art, and alternative elements that may be developed in the future, such as those that one skilled in the art might, upon development, recognize as an alternative. Further, the disclosed embodiments include a plurality of features that are described in concert and that might cooperatively provide a collection of benefits. The present invention is not limited to only those embodiments that include all of these features or that provide all of the stated benefits, except to the extent otherwise expressly set forth in the issued claims. Any reference to claim elements in the singular, for example, using the articles "a," "an," "the" or "said," is not to be construed as limiting the element to the singular. Any reference to claim elements as "at least one of X, Y and Z" is meant to include any one of X, Y or Z individually, any combination of X, Y and Z, for example, X, Y, Z; X, Y; X, Z; Y, Z, and/or any other possible combination together or alone of those elements, noting that the same is open ended and can include other elements.

Reference throughout this specification to "a current embodiment" or "an embodiment" or "alternative embodiment" means that a particular feature, structure, or characteristic described in connection with the embodiment is included in at least one embodiment herein. Accordingly, the appearance of the phrases "in one embodiment" or "in an embodiment" or "in an alternative embodiment" in various places throughout this specification are not necessarily all referring to the same embodiment. Additionally, the particular features, structures, or characteristics of one embodiment are contemplated for proper and full combination in any suitable manner in one or more other embodiments, which is fully contemplated herein. Further, features, structures, or characteristics of one embodiment or multiple embodiments are readily and completely mixed and matched with any features, structures, or characteristics of any other embodiment or multiple embodiments in varying combinations and permutations.

What is claimed is:

1. A footwear construction configured to reduce a rate of pronation of a user, the footwear construction comprising:

an upper;

a midsole body joined with the upper, the midsole body extending longitudinally from a heel region, through an arch region to a forefoot region, the midsole body including a longitudinal axis disposed between a lateral side and a medial side, the midsole body defining a midsole body recess that extends from the lateral side to the medial side;

a stability platform extending within the midsole body recess from the heel region toward the arch region, the stability platform having a lateral wing disposed in the midsole body recess on the lateral side, and a medial wing extending in the midsole body recess on the medial side, the stability platform including a transition portion joining the lateral wing and the medial wing across the longitudinal axis; and a stability frame having an upwardly arching shape joined with the stability platform and joined with the midsole body, the stability frame extending within the heel region and the arch region, the stability frame at least partially sandwiched between the stability platform and the midsole body;

wherein the stability frame includes a first flange that transitions to a second flange that is transverse to the first flange;

wherein the second flange extends inwardly toward the longitudinal axis and terminates on the medial side of the longitudinal axis;

wherein the second flange is sandwiched between the midsole body and the medial wing; and wherein the first flange includes an interior surface joined with the midsole body and an exterior surface extending upwardly above the medial wing and is exposed to a viewer of the medial side of the midsole body, whereby the stability frame and the stability platform on the medial side are operatively configured to reduce a rate of pronation of a user of the footwear construction during a gait cycle of the user.

2. The footwear construction of claim 1, wherein the lateral wing, the transition portion and the medial wing form an unbalanced hourglass shape when viewed by the user from a bottom view of the footwear construction, wherein the medial wing is larger than the lateral wing.

3. The footwear construction of claim 1, wherein the lateral wing and the medial wing are anchored within the midsole body recess across the longitudinal axis, wherein the transition portion includes a transition thickness, wherein the lateral wing includes a lateral wing thickness, wherein the medial wing includes a medial wing thickness, wherein the transition thickness is less than the medial wing thickness, wherein the transition thickness is less than the lateral wing thickness.

4. The footwear construction of claim 3, wherein the transition portion defines a trough adjacent the longitudinal axis between the lateral wing and the medial wing.

5. The footwear construction of claim 1, wherein the first flange and the second flange extend forwardly in the heel region and extend into the arch region.

6. The footwear construction of claim 1, wherein the lateral wing includes a first length extending parallel to the longitudinal axis, wherein the medial wing includes a second length extending parallel to the longitudinal axis, wherein the second length is greater than the first length such that the medial wing extends farther within the heel region and arch region on the medial side than the lateral wing extends within the heel region and the arch region on the lateral side.

7. The footwear construction of claim 1, wherein the stability frame includes an upwardly arcuate shape, and an L shaped cross section, wherein the stability frame is partially sandwiched between the midsole body and the stability platform in the midsole body recess and further extends upwardly along an exterior of the midsole body on the medial side in an exposed manner.

8. A footwear construction configured to reduce a rate of pronation of a user, the footwear construction comprising: an upper; a midsole body joined with the upper, the midsole body extending longitudinally from a heel region, through an arch region to a forefoot region, the midsole body including a longitudinal axis disposed between a lateral side and a medial side, the midsole body defining a midsole body recess that extends from the lateral side to the medial side across the longitudinal axis; a stability platform extending within the midsole body recess from the heel region toward the arch region, the stability platform having a lateral wing disposed in the midsole body recess on the lateral side, and a medial wing extending in the midsole body recess on the medial side, the stability platform including a transition portion joining the lateral wing and the medial wing across the longitudinal axis; and a stability frame disposed entirely on the medial side of the longitudinal axis, the stability frame joined with the stability platform and joined with the midsole body only on the medial side of the longitudinal axis, the stability frame extending within the heel region, whereby the stability frame and the stability platform on the medial side are operatively configured to reduce a rate of pronation of a user of the footwear construction during a gait cycle of the user, wherein the lateral wing includes a first length extending parallel to the longitudinal axis, wherein the medial wing includes a second length extending parallel to the longitudinal axis, wherein the second length is greater than the first length such that the medial wing extends farther within the heel region on the medial side than the lateral wing extends within the heel region on the lateral side, wherein the stability frame includes a first flange that transitions to a second flange that is transverse to the first flange, wherein the first flange and the second flange extend forwardly in the heel region and extend into the arch region, wherein the second flange is sandwiched between the midsole body and the stability platform, wherein the second flange extends inwardly toward the longitudinal axis and terminates on the medial side of the longitudinal axis, wherein the first flange is disposed exterior to the midsole body along the medial side and exposed to a viewer of the midsole body on the medial side, wherein the lateral wing, the transition portion and the medial wing form an unbalanced hourglass shape when viewed by the user from a bottom view of the footwear construction, wherein the medial wing is larger than the lateral wing.

* * * * *